US005375725A

United States Patent [19]

Rosenthal

[11] Patent Number: 5,375,725

[45] Date of Patent: Dec. 27, 1994

[54] MERCHANDISE DISPLAY AND DISPENSING PEG HOOK

[75] Inventor: David Rosenthal, Brooklyn, N.Y.

[73] Assignee: Thomson-Leeds Company, Inc., New York, N.Y.

[21] Appl. No.: 164,209

[22] Filed: Dec. 9, 1993

[51] Int. Cl.[5] ..... A47F 7/00

[52] U.S. Cl. ..... 211/59.1; 211/59.2; 248/301; 248/306

[58] Field of Search ..... 211/59.1, 59.2; 248/301, 306, 222.1, 304, 220.3, 220.4

[56] References Cited

U.S. PATENT DOCUMENTS

| | | | |
|---|---|---|---|
| 536,445 | 3/1895 | Rockwell | 211/59.1 X |
| 829,332 | 8/1906 | Hammer | 248/306 |
| 1,644,155 | 10/1927 | Scott | 211/59.1 X |
| 2,787,435 | 4/1957 | Shields | 248/306 |
| 2,925,239 | 2/1960 | Luck | 248/301 |
| 3,861,631 | 1/1975 | Shorin | 248/301 X |
| 4,106,734 | 8/1978 | Walitalo | 211/59.1 X |
| 4,474,300 | 10/1984 | Entis | 211/59.1 X |
| 4,889,304 | 12/1989 | Glickman et al. | 211/59.1 X |
| 4,907,774 | 3/1990 | Shaw et al. | 248/306 |
| 5,114,021 | 5/1992 | Fredrickson | 211/59.1 X |
| 5,123,189 | 6/1992 | Fast et al. | 211/59.1 X |

*Primary Examiner*—Ramon O. Ramirez
*Assistant Examiner*—Korie H. Chan
*Attorney, Agent, or Firm*—Brooks Haidt Haffner & Delahunty

[57] ABSTRACT

A peg hook for dispensing suspended packages or other articles has a resilient tongue near its front end for preventing removal of more than one article at a time. The hook is preferably formed as one piece of plastic material and has spaced fingers for fitting into holes in a pegboard backing panel so that the hook extends horizontally.

12 Claims, 2 Drawing Sheets

MERCHANDISE DISPLAY AND DISPENSING PEG HOOK

BACKGROUND OF THE INVENTION

Drugstores and retail shops commonly sell a wide variety of products enclosed in small packages designed to be hung from hooks, including blister or bubble packages of the type which have a transparent front panel through which the product can be seen and a generally flat stiff back member or card as well as opaque packages formed with an apertured extending tab. An aperture through the upper edge portion of the back member or card or through a tab extending from the package permits the packaged products to be displayed on and dispensed from an elongated rod or hook which extends essentially horizontally from a support panel, typically made of pegboard having a multiplicity of equally spaced apertures for securing the rods or hooks in place.

Such displays are attractive to prospective purchasers, who can serve themselves by removing a package from its hook, but they are also attractive to pilferers who can scoop all of the packages off their hook in a single one-handed motion, causing the merchandise to fall undetected into a bag or pocket. Packages can also be accidentally knocked off such open hooks by a person brushing against a display.

Attempts have been made to combat such larceny and accidental displacement of packages from their hooks. For example, Wilkins U.S. Pat. No. 3,481,482 shows a peculiarly shaped dog mounted on a bracket, which is intended to require movement of the dog with one hand to align the dog with a specially shaped aperture in a merchandise card to enable the card to be removed from the bracket by the purchaser's other hand. Niven U.S. Pat. No. 5,014,949 shows a product card holder formed of wire or of flat stock with S-shaped bent portion to impede quick removal of the cards by a thief or vandal. U.S. Pat. No. 4,109,795 to Konigsford et al. employs a bracket formed with a stop-notch and an adjacent protuberance of increased cross-sectional area to prevent packages from sliding readily off the bracket.

The various attempted solutions presented by the prior art have not been completely satisfactory because of manufacturing expense, complexity or aesthetic considerations.

The hook of the present invention is simple and inexpensive to manufacture, attractive in appearance, sturdy and safe.

SUMMARY OF THE INVENTION

The merchandise display and dispensing peg hook of the invention is preferably integrally formed with means at one end of the generally flat, elongated hook body for ready attachment to an upright panel such as a pegboard support panel, and with a normally raised resilient tongue member near the other, outer end of the hook body, which resilient tongue member must be depressed to permit removal of a single package suspended from the body of the peg hook. The tongue member resiliently returns to its normal raised condition after the customer has removed from the hook a single package. The distal portion of the peg hook, where the tongue member is located, preferably has a wavy configuration when viewed from the side, the wavy configuration cooperating with the raised tongue member to prevent passage of an aperture in a package over the distal portion of the hook when the tongue member is in its normal raised position, but permitting removal of a package when a purchaser squeezes the hook to depress the tongue member.

The tongue member has a free inner end and joins the body of the peg hook near the hook's outer end. Preferably space is provided on both sides of the tongue member so that the tongue member can be depressed to a generally congruent relationship with portions of the hook body on either side of the tongue member. This permits the passage over the depressed tongue member of the restricted aperture typically provided in the card or backing element of a bubble or blister package or in a tab extending from an edge of a conventional opaque package.

BRIEF DESCRIPTION OF THE DRAWINGS

In the several figures of the drawings, in which like reference characters are used to designate like parts throughout.

DETAILED DESCRIPTION OF A PREFERRED EMBODIMENT

Figures 1, 2:
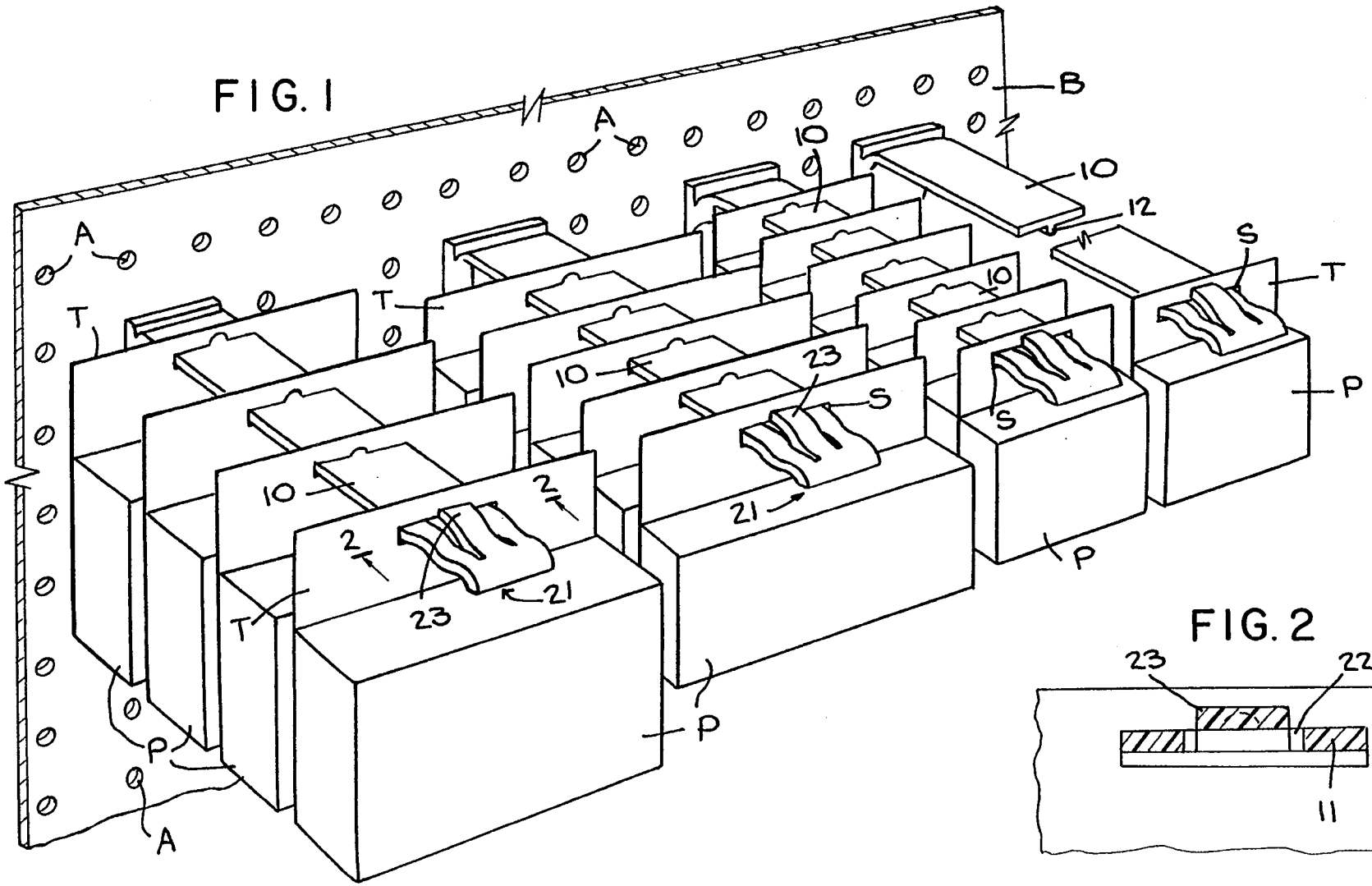
FIG. 1 shows a portion of a typical display of packages presented on merchandise display and dispensing hooks according to the invention, with the hook at the far right shown partially cut away to illustrate cross-sectional structure.
FIG. 2 is a view in section, taken along line 2—2 of FIG. 1 and looking in the direction of the arrows, of a hook according to the invention.

The perspective view of FIG. 1 shows four peg hooks according to the invention, generally designated by the reference numeral 10, secured to a conventional backboard B which has a multiplicity of equally laterally spaced apertures A. Packages of different sizes are shown suspended from the peg hooks 10. The packages P are shown to have tabs T extending upwardly from their rear faces, and each of the tabs T has a centrally located, longitudinally extending, slot-like hole S for attachment to a suspension member, which could be a conventional bracket or hook, but which also accommodates the display and dispensing hook 10 of the invention as shown.

The various packages P shown in the drawings are merely illustrative of any packages that have slot-like holes S for suspension from hooks or brackets. The hooks 10 of the invention can be employed to display and dispense opaque packages with projecting apertured tabs T as illustrated or bubble or blister wrap packages similarly provided with an elongated suspension slot for hanging on display hooks or brackets. In some cases, the merchandise itself has such a suspension slot S and is not packaged but hangs directly from a bracket or hook. The peg hook of the invention can be employed in the display of a wide variety of articles.

Figure 4:
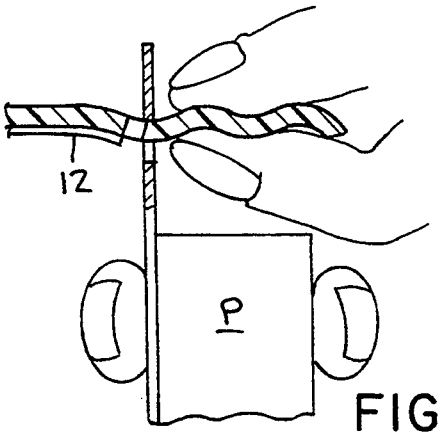
FIG. 4 illustrates the way in which the tongue member of the hook of the invention is squeezed to depress the tongue member for removal of a package.
Figure 5:
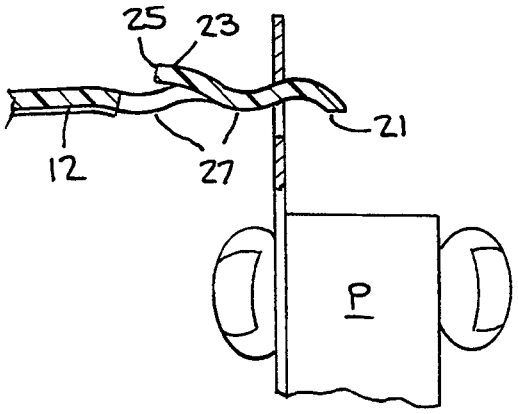
FIG. 5 shows how the tongue member of the hook returns to its normal, raised position after a package has been moved past the tongue member.
Figure 6:
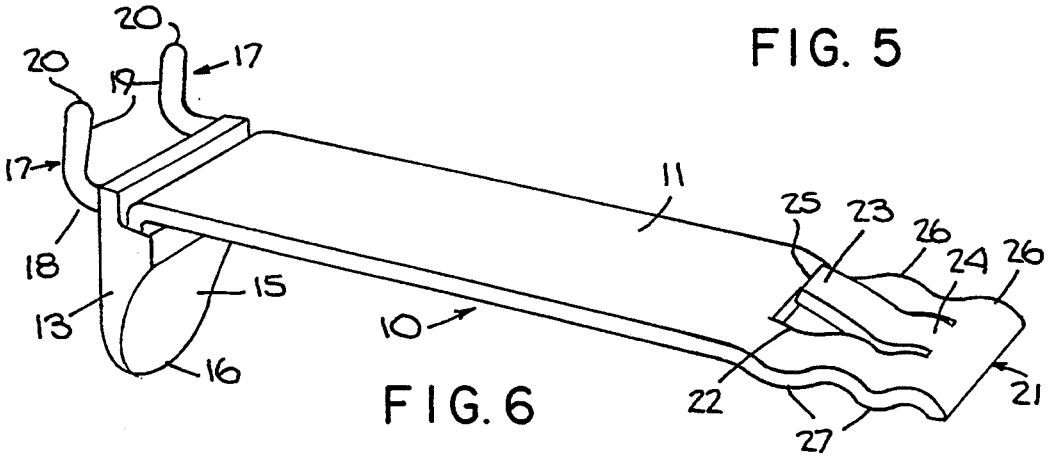
FIG. 6 is a view in perspective of a peg hook according to the invention.

The peg hook 10 is shown in FIG. 6 to have an elongated flat body portion 11 of sufficient length to carry a number of articles. It will be understood that depending upon the application, the length of the body portion 11 of the hook 10 can be freely selected. Thus, for example, the overall length of the hook 10 could be anywhere from about 4 to 12 inches depending on the number, weight and bulk of the packages P to be disposed thereon, provided that the material, preferably a plastic material, from which the hook 10 is made, is of sufficient rigidity that the body 11 of the hook extends essentially perpendicular to the backboard B as illustrated in the drawings when the hook is loaded with packages P. Rigidity of the hook body portion 11 can preferably be enhanced by the provision of a longitudinally extending rib 12 which is shown formed as an integral part of the peg hook 10 as best seen in FIGS. 1 and 3–5.

Figure 3:
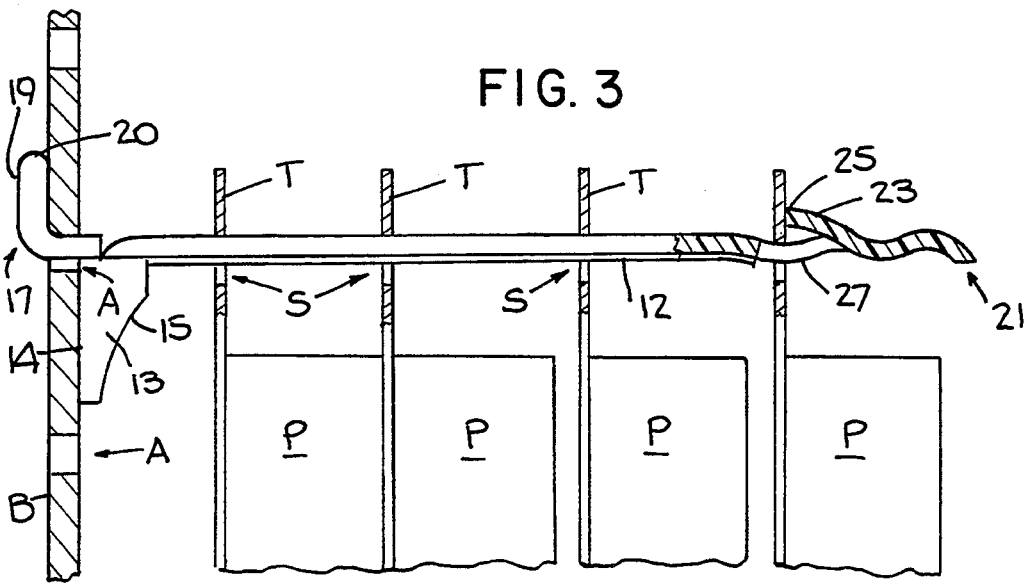
FIG. 3 is a side view in section of a hook of the invention.

The rear or inner end of the peg hook 10 has a support element 13 which extends downwards and generally perpendicular to the plane of the hook body 11 as seen in FIGS. 3 and 6. The support element 13 has a flat back face 14 which abuts the front surface of the backboard B to maintain the hook 10 in its horizontal position. The front face 15 of the support element 13 can be smoothly curved as shown for ease of installation of the hook 10 and the support element 13 may have its lower edge 16 rounded, all as shown in FIG. 6.

A pair of crooked fingers 17 formed at the extreme end of the peg hook 10 are spaced to engage the apertures A of the pegboard support panel B. Each finger 17 has a horizontal part 18, somewhat greater in length than the thickness of the support panel B and an upwardly turned tip part 19 which abuts the rear face of the support panel B as shown in FIG. 3. The tip parts 19 preferably have rounded ends 20 for safety. Generally, the entire peg hook 10 should have no sharp or pointed edges or surfaces, to prevent accidental injuries, which can occur when conventional wire hooks are used in merchandise displays.

The peg hook 10 is mounted to the backboard B by tilting the hook 10 for insertion of the fingers 17 into and through the apertures A of the support panel B and then lowering the hook 10 to its installed horizontal position as shown in FIGS. 1 and 3, in which condition the rear face of the support element 13 seats against the front face of the panel B. If desired, the rear face of the support element 13 can be glued to the front face of the panel B to prevent undesired removal or dislodgement of the hook 10.

The distal end 21 of the hook 21 can be squared off as shown in FIGS. 1 and 6 or rounded. Just to the rear of the hook end 21, the body 11 of the hook 10 is formed with a longitudinally extending central, generally rectangular slot 22 which is slightly wider and longer than the tongue member 23 located within the slot 22 as can be seen in FIGS. 2 and 6. The tongue member 23 is integrally formed with the hook body 11 and extends rearwardly from a base portion 24 where it emerges from the hook body 11 near the end 21 thereof. The tongue member 23 and the entire hook body 11 are formed, for example, by casting and cutting of a relatively rigid but somewhat flexible synthetic resinous material. As shown in the several figures of the drawing, the tongue member 23 is normally bent upwards and has its inner end 25 elevated above the plane of the upper surface of the hook body 11.

The portion of the hook body 11 along both sides of the slot 22 preverably has a wavy contour. The presently preferred profile of this portion of the hook body 11 is seen in FIGS. 4–6 to comprise two waves, that is, two crests 26 and two troughs 27, with the inner tip 25 of the tongue 23 located above the inner trough 27, whereby the total vertical thickness of the hook 10 at the location of the inner end 25 of the tongue member 23 is normally considerably greater than the thickness of the rest of the hook body 11. The rib 12 can extend to the trough 27, providing some added thickness. This vertical dimension, that is, the distance from the upraised tip 25 of the tongue 23 to the bottom surface of the hook body 11 at the inner or rear trough 27, is chosen to be greater than the space between the upper and lower edges of the slot-like hole S of packages P suspended from the hook 10. A package P cannot be slid off the hook 10 when the tongue member 23 is in its normal raised state because the slot-like hole S in the package tab or edge T cannot pass around the tongue member 23. This is best shown in FIG. 3 where the package P closest to the free end 21 of the hook 10 is blocked from removal by the raised tongue member 23.

In order to remove the package P a purchaser grips and squeezes the hook 10 to depress the tongue member as shown in FIG. 4, using the fingers of his or her other hand to slide the package P outward on the hook 10. Once the package P is past the tongue member 23, as shown in FIG. 5, the purchaser can release the tongue 23, allowing the tongue to move back resiliently to its upraised condition. The package P can then be moved forward past the distal end 21 of the hook, which is shown as downturned in the drawings for easy package removal. Only one package P at a time can be removed, since both of the customer's hands are required to manipulate the tongue 23 and package P simultaneously. Nevertheless, removal of a single package is simple and easy, as is the loading of packages on to the hook.

The slot-like suspension hole S provided through the cards or tabs of typical products is about one and one quarter inch wide and about one quarter inch in height at its greatest vertical dimension, although packages may vary. Thus, the peg hook of the invention can have a hook body 11 about one inch in width for sliding reception within the package hole S. To prevent passage of the one-quarter inch vertical dimension of the typical package suspension hole S, the distance between the upper end of the tongue tip 25 and the base of the trough 27 opposite the tip 25 is preferably about three-eights of an inch. What is necessary is that the width of the hook body 11 is somewhat smaller than the width of the package aperture S and that the vertical distance between the upper and lower surfaces of the hook 10 at the tip 25 of the raised tongue member 23 is somewhat greater than the vertical dimension of the package hole S, so that the tongue 23 must be squeezed down in order for a package P to be slid off the hook 10.

The dimensions of the hook 10 of the invention can, of course, be chosen to suit the dimensions of the holes S of packages or other articles to be displayed and dispensed. The length of the hook body 11 can be chosen to accommodate a selected number of articles, provided that the hook 10 is not made so long as to bend under the weight of suspended packages. Thus, the overall length of the hook 10 of the invention can be about four to twelve inches. The back support 13 of the hook 10 is shown as slightly wider than the hook body 11, and the fingers 17 would ordinarily be spaced apart in accordance with the spacing of the apertures A in a backboard, for example, one inch apart or some multiple of one-half inch in the case of holes spaced one-half inch apart for conventional pegboard employed in the United States. Metric dimensions could also readily be accommodated when required.

Various modifications, choices of materials and the like will suggest themselves to those acquainted with the art. For example, the inner edge of the slot 22 and/or the tip 25 of the tongue member could be curved rather than straight as shown. Two or more longitudinal ribs could be employed rather than the single rib 12 illustrated, or the rib 12 could be omitted. The hook need not be integrally formed as in the presently preferred embodiment. For example, the rear support 13 could be formed separately from the hook body 11 and then secured thereto.

What is described and shown is a merchandise display and dispensing peg hook which permits removal of only one item at a time.

What is claimed is:

1. A one-piece hook for the display and dispensing of articles of the type which have holes for suspending the articles from the hook, the hook comprising a generally flat elongated hook body with an upper surface defining a plane, a pair of spaced, upwardly crooked fingers formed at and extending beyond and upwards from an inner end of the hook body for securing the hook to a vertical surface so that the hook body extends horizontally and generally perpendicular to the vertical surface for suspending a plurality of articles, a support element extending downwards from said inner end for supporting the hook, and a depressible resilient tongue member which protrudes out of the horizontal plane defined by the surface of the hook body and extends rearwards toward the inner end, whereby the tongue member must be depressed toward said plane to remove an article from the hook.

2. The hook of claim 1, including an aperture defined in the hook body and wherein the tongue member overlies said aperture.

3. The hook of claim 1 and including a reinforcing rib extending along the hook body.

4. The hook of claim 1 wherein the entire hook is formed of synthetic resinous material.

5. A one-piece display and dispensing hook having a pair of spaced, crooked fingers extending rearwardly and upwardly from an inner end of an elongated flat hook body for attachment of the hook to a vertical surface so that said hook body provides horizontal surface for suspension of articles the flat body of the hook by means of holes formed in the articles, and a support element extending downwards from said inner end for supporting the hook, the hook body including a protruding, raised tongue member extending rearward from and joined with the hook body at a forward portion of the hook body, said tongue member being formed of resilient material whereby said tongue member can be depressed for permitting removal from the hook of only one article at a time.

6. The hook of claim 5 wherein a portion of the hook body adjacent the tongue member is wavy in profile for cooperating with the tongue member in permitting removal of said article from the hook.

7. The hook of claim 5 wherein the hook body is formed with an aperture extending beneath the tongue member when the tongue member is in raised condition.

8. The hook of claim 5 formed as one piece of plastic material.

9. A one-piece merchandise display and dispensing peg hook of the type which is adapted to be mounted on and to extend horizontally from an essentially vertical display panel for the display of articles having holes for suspension of the articles from the hook, said hook comprising an elongated, generally flat hook body, pair of spaced, crooked fingers extending rearward and upward from an inner end of said hook body for securing the hook to a vertical surface, a support element extending downward from said inner end for supporting the hook, said hook body having an upper surface defining a plane and a depressible, resilient tongue member which protrudes out of the plane defined by the surface of the hook body and extends inwards toward said inner end, whereby said tongue member must be depressed toward said plane in order to remove an article from the hook.

10. The hook of claim 9 wherein an aperture is defined in said hook body and said tongue member overlies said aperture so that upon depression of said tongue member, the tongue member moves toward aperture.

11. The hook of claim 9 wherein the entire hook is formed of synthetic resinous material.

12. The hook of claim 9 wherein a portion of the hook body adjacent the tongue member is wavy in profile for cooperating with the tongue member to prevent removal of more than one article at a time from said hook.

* * * * *